US007896131B2

(12) United States Patent
Bronkhorst

(10) Patent No.: US 7,896,131 B2
(45) Date of Patent: Mar. 1, 2011

(54) PORTABLE TEMPORARY SUPPORT FOR WORKERS

(76) Inventor: Craig S. Bronkhorst, Brandon, WI (US)

( * ) Notice: Subject to any disclaimer, the term of this patent is extended or adjusted under 35 U.S.C. 154(b) by 785 days.

(21) Appl. No.: 11/880,932

(22) Filed: Jul. 25, 2007

(65) Prior Publication Data

US 2008/0022628 A1 Jan. 31, 2008

Related U.S. Application Data

(60) Provisional application No. 60/833,129, filed on Jul. 25, 2006.

(51) Int. Cl.
*E04G 3/26* (2006.01)

(52) U.S. Cl. ..... 182/45

(58) Field of Classification Search ..... 182/45
See application file for complete search history.

(56) References Cited

U.S. PATENT DOCUMENTS

| | | | | |
|---|---|---|---|---|
| 1,369,780 | A | | 3/1921 | Burgess |
| 2,388,420 | A | | 2/1944 | Kott |
| 2,448,427 | A | | 8/1948 | Gordon |
| 3,541,313 | A | * | 11/1970 | Buzzi ..... 297/195.11 |
| 3,863,978 | A | * | 2/1975 | Gillings, Jr. ..... 296/63 |
| 3,959,945 | A | * | 6/1976 | Allen ..... 52/690 |
| 4,346,784 | A | | 8/1982 | Hammond |
| 4,491,193 | A | | 1/1985 | Moss |
| 4,928,789 | A | * | 5/1990 | Claeys ..... 182/3 |
| 4,958,789 | A | * | 9/1990 | Shigeki et al. ..... 248/56 |
| 5,038,761 | A | | 8/1991 | Richardson |
| 5,148,890 | A | | 9/1992 | Sipe |
| 5,165,642 | A | * | 11/1992 | Rihaly ..... 248/237 |
| 5,282,597 | A | | 2/1994 | Babcock |
| 5,380,021 | A | | 1/1995 | Doherty |
| 5,638,917 | A | | 6/1997 | Vennen |
| 5,829,549 | A | | 11/1998 | Flynn |
| 5,882,081 | A | | 3/1999 | Earl |
| 5,988,578 | A | | 11/1999 | Davies |
| 6,820,722 | B2 | | 11/2004 | Severt |
| 7,121,629 | B2 | * | 10/2006 | Chou ..... 297/487 |
| D575,024 | S | * | 8/2008 | Mays et al. ..... D34/23 |

* cited by examiner

*Primary Examiner*—Alvin C Chin-Shue
(74) *Attorney, Agent, or Firm*—Ryan Kromholz & Manion, S.C.

(57) ABSTRACT

A portable worker support bracket for releasable engagement of a work surface such as a truss member or other construction member.

8 Claims, 6 Drawing Sheets

PORTABLE TEMPORARY SUPPORT FOR WORKERS

RELATED APPLICATION

This application claims the benefit of provisional patent application Ser. No. 60/833,129 filed 25 Jul. 2006.

BACKGROUND OF THE INVENTION

The present invention relates to worker support systems for use in improving the safety, efficiency, and convenience of building construction workers when installing roof trusses or the like. More particularly, the present invention consists of a portable worker support bracket that is releasably engagable with a roof truss or other structure. The bracket is for use in the construction industry, particularly in the construction of frame buildings, specifically during the erecting of roof frames. A roof frame is characteristically formed of a series of trusses which are spaced apart using truss spacers, or the like. Typically, a worker involved in placing and securing the trusses is perched atop a truss while receiving, accurately spacing, and securing each subsequent truss in the roof series. Workers climb over each subsequent truss as each additional truss is hoisted to them by crane. This work arrangement is awkward and dangerous.

Other similar work environments, such as that encountered in the iron working industry, also require workers to continuously move about to position and secure various components, with much of the work being done while the worker straddles a component such as a beam.

Typically, adequate and convenient support means for truss and joist workers is either non-existent or inconvenient. The present invention seeks to provide a secure, portable and convenient device to aid workers in various environments, such as roof construction.

SUMMARY OF THE INVENTION

The present device endeavors to provide a more secure working arrangement that is portable, easily manipulated by a worker, and flexible in its application. The invention allows workers erecting roof trusses, for example, to more securely stabilize themselves on a roof truss while working on neighboring trusses. The invention further provides a device that allows a worker to work more safely and efficiently on steeply inclined surfaces, and further permits the worker to more safely utilize both hands when working. The present invention also provides a device that can be utilized with many types of trusses and beams, and may also include means to store and carry articles to the work site.

To accomplish the above objectives, the worker support of the present invention is formed from a support bracket which can be releasably secured to a truss member or beam, and is of a size and weight easily lifted and manipulated by a single worker. In one embodiment of this invention, the support structure is configured to fit over the truss or beam that has already been secured in place so that a worker can straddle it and be supported. A worker straddles the support bracket, which allows the worker, if working in a roof construction environment, to work on an adjacent truss that is not yet secured. By using a pair of the brackets, the worker can move from truss to truss by moving the bracket not in use to a newly completed truss, then moving from the bracket being used to the new bracket so that the worker is then supported on the newly secured truss and in position to guide a new truss into position so that it can be secured. The process is repeated until all trusses have been secured.

A preferred embodiment of the invention comprises a three-sided bracket which includes a pair of spaced apart side walls, defining a channel therebetween, and at least one overlying cross member. The bracket further preferably includes releasable fastening means for engagement of the truss. The bracket is designed to fit over the top of a truss so as to engage the truss and support a worker thereon, and is preferably sufficiently rigid to fit closely over the truss, such that the bracket closely aligns with the slope of the truss when a worker is supported thereon. The bracket further includes support structures for the legs or feet of the worker to provide worker stability while straddling the bracket.

One means of attaching the support bracket to a truss or the like is by a nail and keyhole arrangement, in which a keyhole is supplied to the inside surface of the cross member, or alternatively, may extend entirely through the cross member, and a corresponding nail is secured by the worker to the truss upon which the support bracket is to be placed. The nail engages the keyhole and assists in reducing longitudinal slippage along the truss or other member upon which the worker is to be supported. Another releasable fastening means for attaching to the support structure is by way of a gripping mechanism, such as a work holding clamp such as a VISE-GRIP®, or alternatively, a cammming device utilizing a pawl or the like incorporated into the channel and adapted to engage a truss or other structure like structure.

The invention also includes a method of erecting trusses, in which a first bracket is attached to a first truss that has been secured in place, a worker straddles the bracket while securing a second, adjacent truss in place, the worker then attaches a second bracket to the second truss and climbs to the second bracket, the worker then straddles the second bracket while securing a third truss in place adjacent the second truss, and the worker moves the first bracket from the first truss onto the third truss. This pattern is repeated until the needed number of trusses has been secured. Alternatively, the method may be practiced using a single bracket wherein the worker simply moves the bracket from a truss to an adjacent truss, while straddling the truss.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
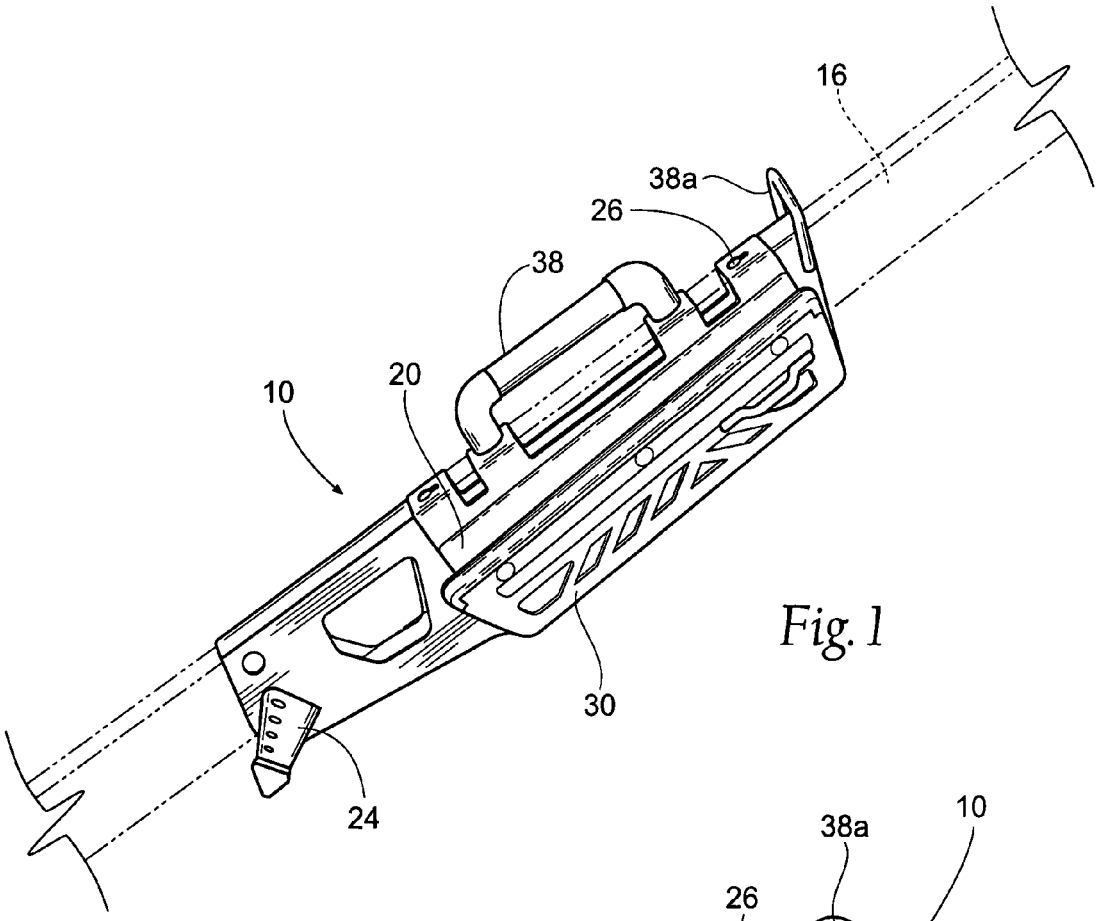
FIG. 1 is a perspective view of an embodiment of the present invention and showing it straddling a truss member by way of example.

As may be seen in the drawings, an embodiment of the present invention comprises a support bracket 10 having a pair of opposed sidewalls 12 defining a channel 14 therebetween, and a cross member 11. As shown particularly in FIGS. 1 and 6, the bracket 10 is adapted to fit over and straddle a truss member 16 (shown in phantom), or other construction member, to thereby provide a base for a worker 18 (shown in phantom) atop the truss member 16. The channel 14 is preferably made having a predetermined width, with the channel width corresponding to the width of the truss member 16 or other construction member to be straddled. This arrangement ensures effective engagement of the bracket 10 to the truss 16 to be worked on. The bracket 10 may be manufactured with a channel 14 of any of a variety of widths, to thereby accommodate work on differently sized trusses 16 or other construction members.

Figure 4:
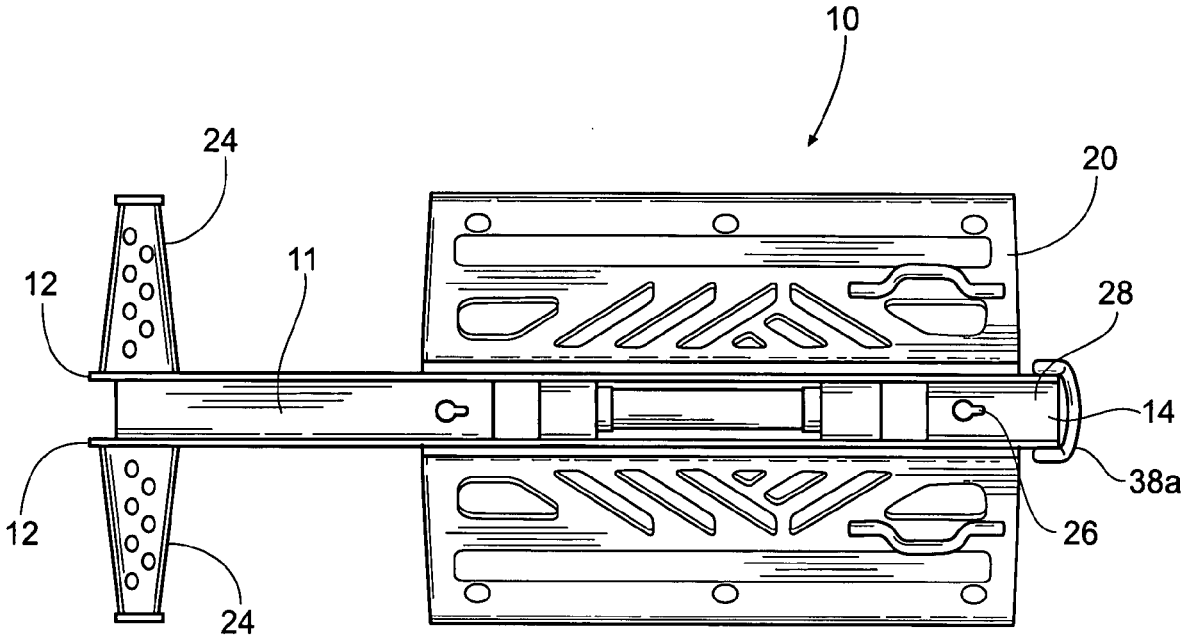
FIG. 4 is a bottom plan view of the embodiment shown in FIG. 3 and illustrating a keyhole in the cross member.

As seen particularly in FIG. 4, each side wall 12 preferably includes a supporting gutter or trough member 20 which extends laterally from the side wall 12 and runs substantially parallel to each side wall 12. The gutter/trough member 20 is designed to receive a worker's lower leg 22 (see FIG. 6) to thereby provide a means for supporting a worker 18 on the bracket 10. The gutter/trough elements 20 may be padded for worker comfort. As may be observed in the Figures, the bracket 10 preferably further includes foot supporting pegs 24 laterally extending from each side wall 12 at a convenient location, for additional worker 18 support.

In use, the bracket 10 is placed over an individual truss 16 or other construction member, with the components being frictionally engaged. Additional attachment of the truss 16 and bracket 10 may be provided by way of releasable fastening means. As illustrated in FIGS. 1-6, the releasable fastening means may include at least one keyhole 26 located on an inside surface 28 of the cross member 11 (see particularly FIG. 4). As further seen, the keyhole 26 may extend entirely through the cross member 11. The keyhole 26 is adapted to engage a nail head (not shown), or other upstanding member positioned and fastened by the worker 18 on a truss 16 at a convenient location. This feature provides additional locking at a specific location on a truss 16 and assists in reducing longitudinal slippage along the truss 16 or other member upon which the worker 18 is to be supported, particularly when the device is used on steep inclines (see FIG. 6). The nails or other upstanding members (not shown) may be added by the worker 18 as needed, or may be attached to the truss 16 before it is elevated in place, as desired.

Figure 7:
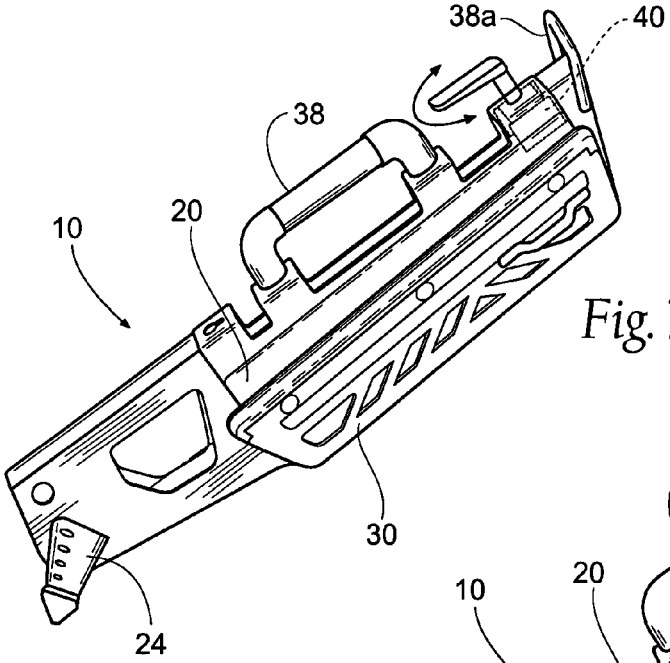
FIG. 7 is a view of an embodiment of the present invention and illustrating an alternative, vice grip attachment mechanism.
Figure 8:
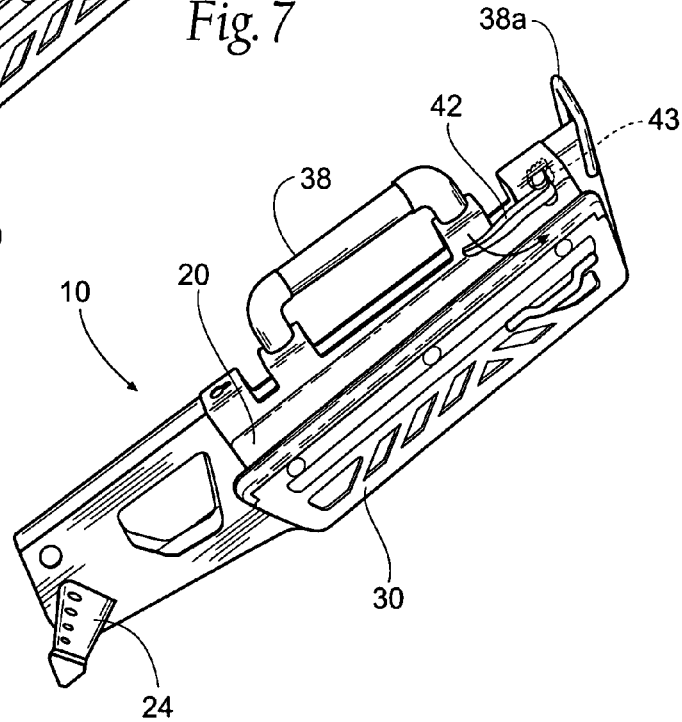
FIG. 8 is a view of an embodiment of the present invention, similar to that of FIG. 7 but showing another alternative attachment mechanism.
Figure 9:
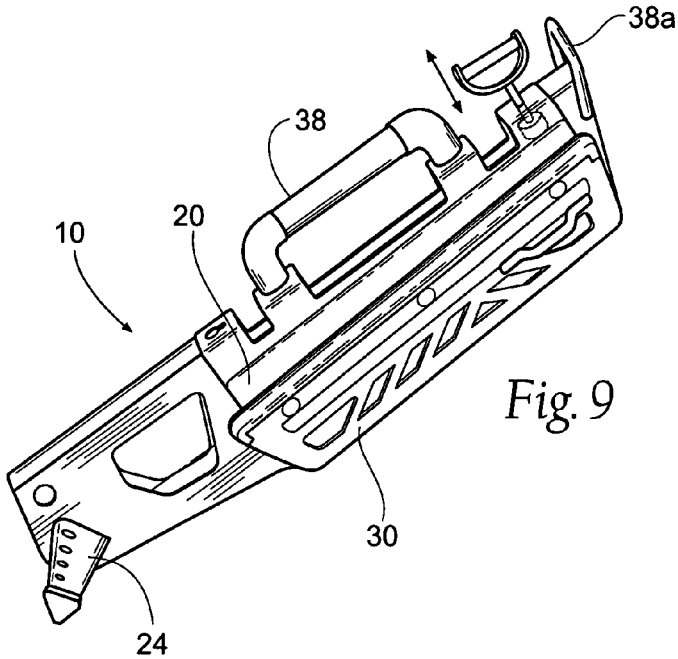
FIG. 9 is a view of an embodiment of the present invention, similar to that of FIGS. 7 and 8, but showing another alternative attachment mechanism.

Alternative releasable fastening means for attaching the bracket 10 to a truss 16 may be seen particularly in the view of FIG. 7, in which a work-holding clamp 40 is incorporated into the channel 14. A suitable work holding clamp 40 may be of the type manufactured by VISE-GRIP®, by way of example. Another alternative releasable fastening means may be seen in FIG. 8 wherein a camming device 42 is illustrated and utilizing a pawl 43, which is incorporated into the channel and adapted to engage a truss or the like. Further is illustrated in FIG. 9, another alternative gripping means.

Figure 2:
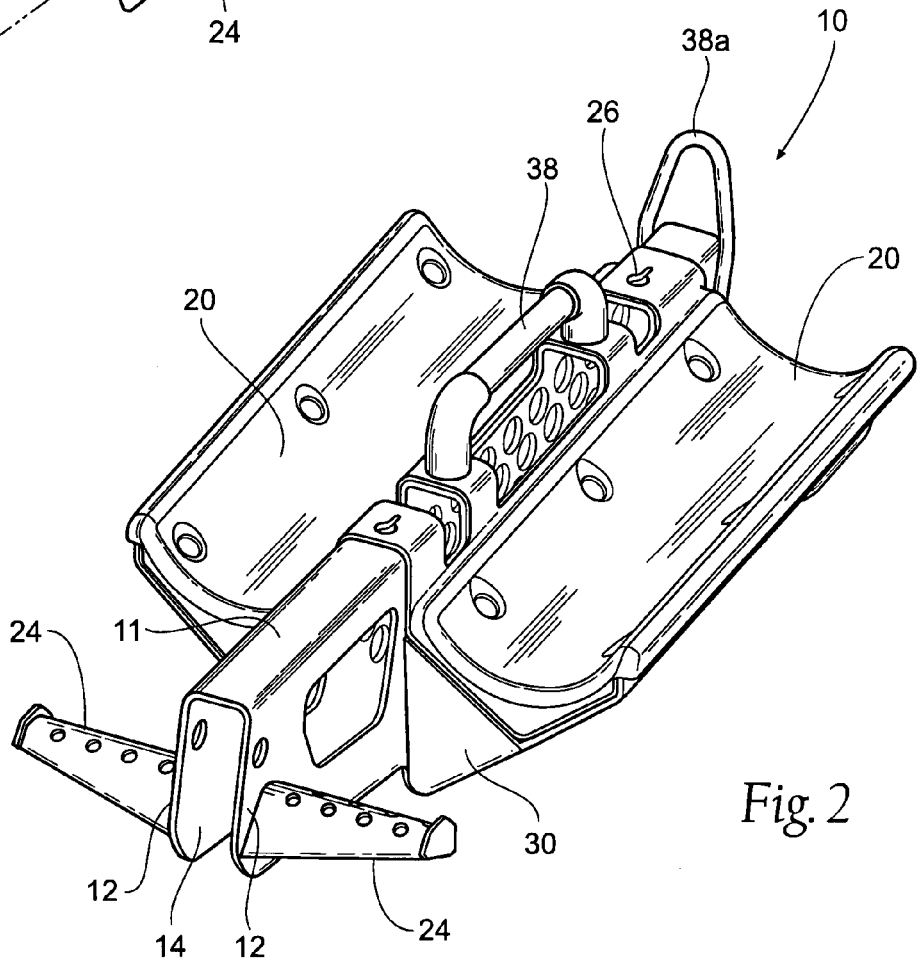
FIG. 2 is a perspective view of an embodiment of the present invention.
Figure 3:
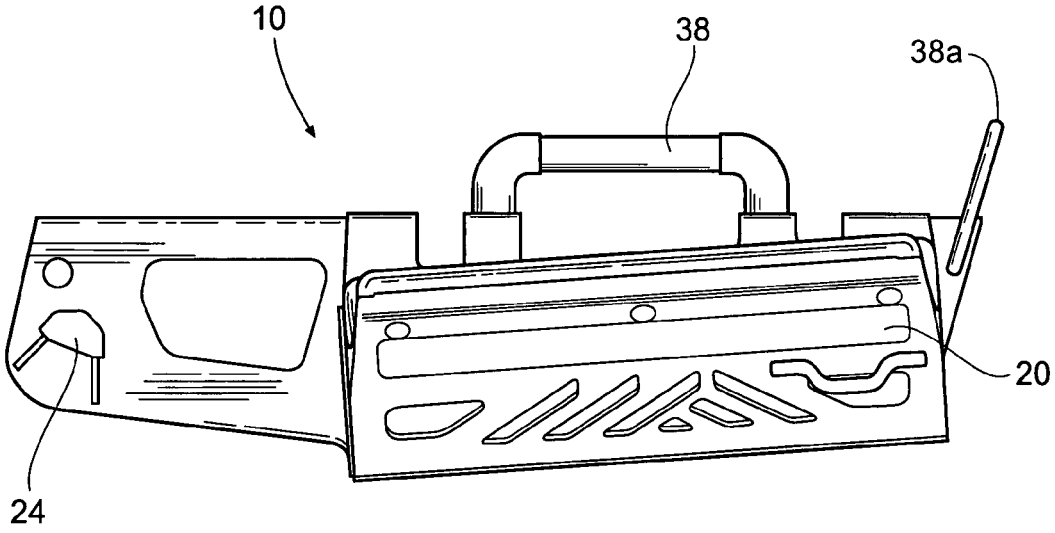
FIG. 3 is a side plan view of the embodiment illustrated in FIGS. 1 and 2.
Figure 5:
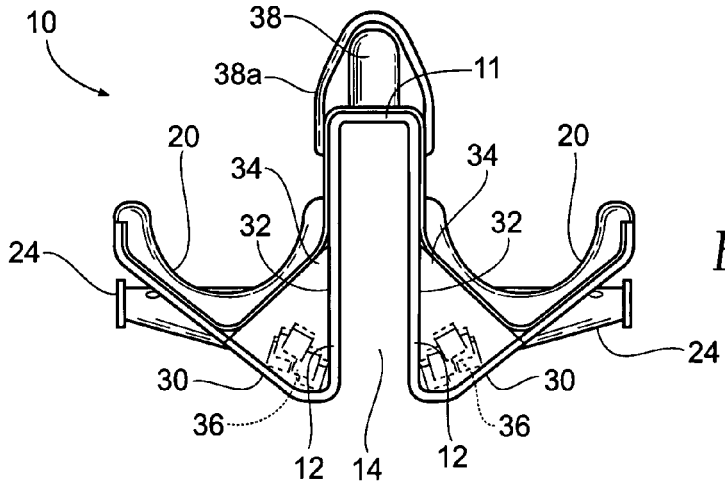
FIG. 5 is an end view of the embodiment shown in FIG. 4.

As may be noted particularly in FIGS. 2 and 5, the bracket 10 further preferably includes angled abutments 30 to provide support and reinforcement for the supporting gutter/trough elements 20. Seen in the Figures, each angled abutment 30 extends laterally from the wall 12 at an angle designed to meet and support the trough element 20. As may be further observed in the Figures, each abutment 30 runs substantially parallel to a corresponding supporting trough element 20. As is illustrated in FIG. 5, the abutments 30 offer an added purpose in cooperating with the outer surface 32 of side walls 12 to form storage areas 34 on the bracket 10. The storage area 34 may be used to bring extra truss spacers 36 (shown in phantom), or the like, to the operation location, thereby adding convenience.

As may be seen in the Figures, the bracket 10 may be further equipped with at least one handle 38 for ease in portability and maneuverability on a job site. The handle 38 may be placed on any convenient bracket surface, as desired, such as the illustrated central handle 38 located on the cross member 11. Additional or alternative handles may be placed on the bracket 10 as required, such as the forward handle **38*a* located on the forward end of the bracket 10 and depicted in the Figures. The handle 38** may also be used to loop a safety cord (not shown) through, if desired.

Figure 10:
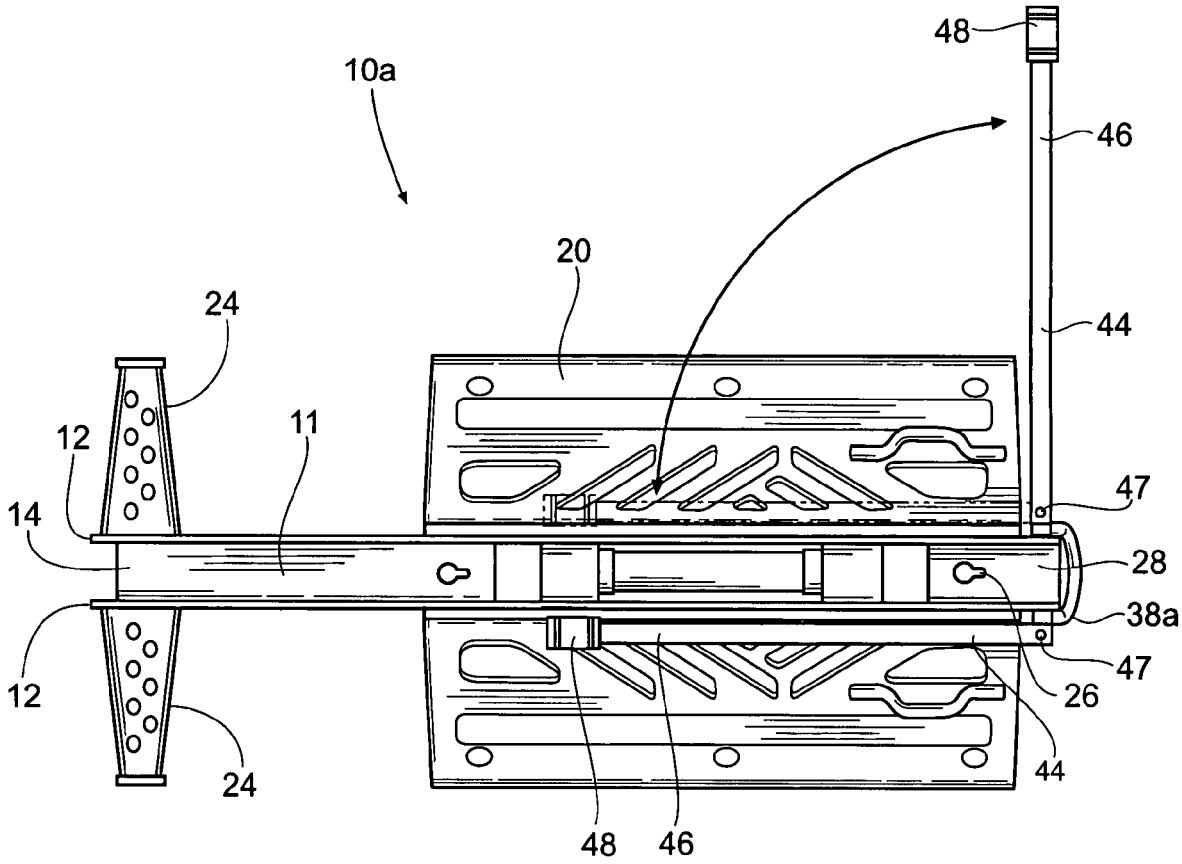
FIG. 10 is a bottom plan view of an embodiment of the present invention and illustrating an attached, hinged spacer arm.
Figure 11:
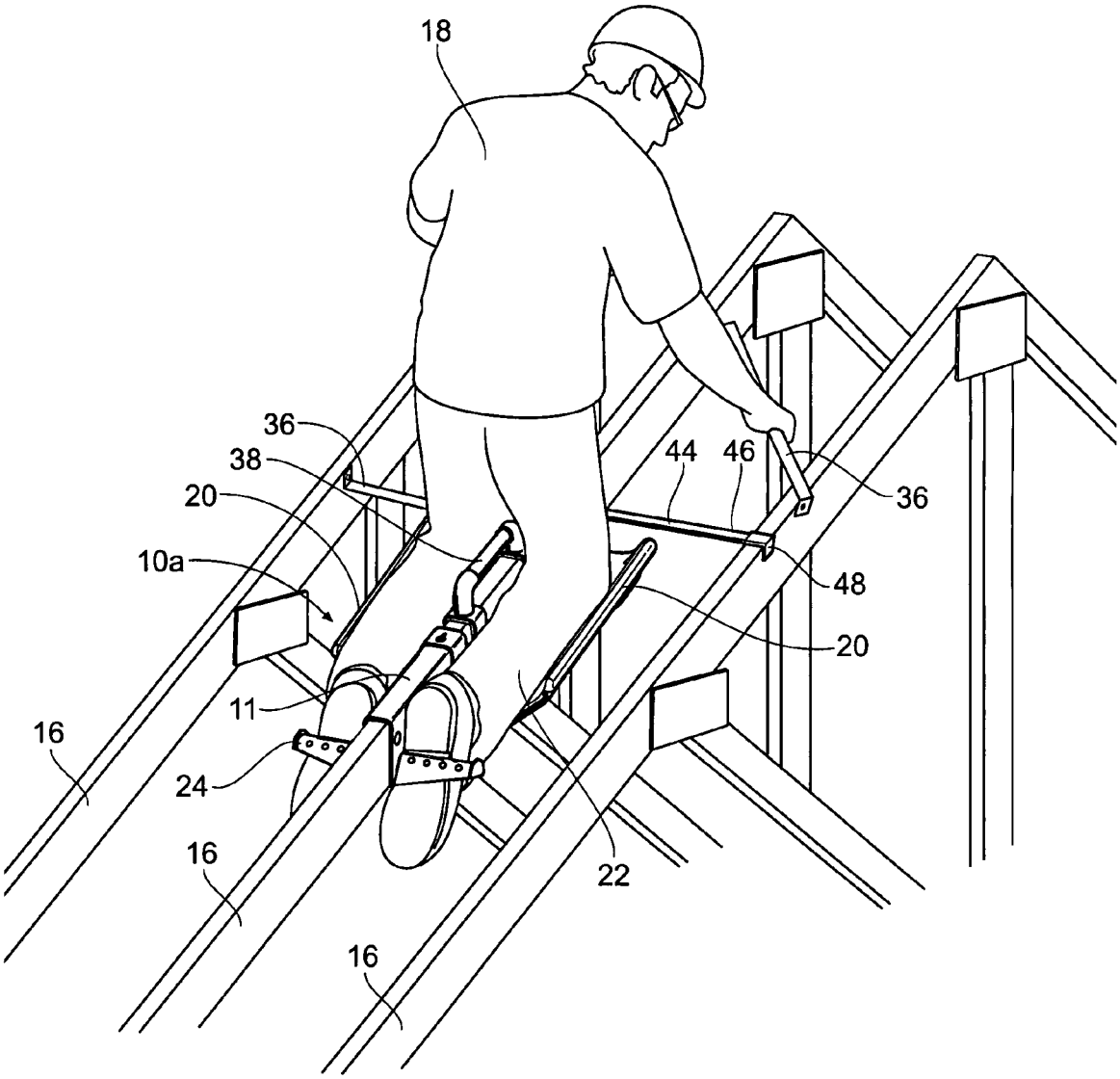
FIG. 11 is a perspective view of the embodiment shown in FIG. 10 in use to support a worker atop a truss and to properly position and space incoming trusses by way of a pivotable spacer arm.

An additional variation of the support bracket of the present invention may be seen in FIGS. 10 and 11. As illustrated, the support bracket 10 as described previously may be further fitted with at least one pivotable spacer arm 44 having a distal end 46 and a proximal end 47. As seen particularly in FIG. 10, the pivotable spacer arm 44 is pivotally connected at its proximal end 47 to the support bracket **10*a*, and is movable between a storage position that is substantially parallel to the sidewalls 12 and an in use position perpendicular the sidewalls 12. As may be observed, FIG. 10 depicts a pivotable spacer arm 44 on each side of the bracket 10*a*. This arrangement allows the user to utilize the pivotable spacer arm 44 feature while working on trusses 16 to either side of the bracket 10*a*. As illustrated in FIG. 11, the pivotable spacer arm 44 is particularly useful in roof truss 16 construction, as it allows a worker to correctly space, and temporarily secure, a new truss 16 in place prior to a permanent spacer bar 36 being attached. This feature allows for more rapid truss 16 placement and permits the crane operator (not shown) assisting the truss worker 18 to more quickly move to the next truss 16** to be secured.

In use, and as depicted in FIG. 11, the appropriate pivotable spacer arm 44 is rotated by the worker 18 supported on the bracket **10*a*, and is used to accurately space the incoming truss 16. The distal end 46 of the pivotable spacer arm 44 is preferably provided with a U-shaped truss grip 48 which the worker 18 places over the incoming truss 16 to be secured, so that the selected pivotable spacer arm 44 holds the truss 16 to be secured while the worker positions and secures the permanent spacer bar 36 to the truss 16. Once the permanent spacer bar 36 is secured, the worker 18 disengages the U-shaped truss grip 48 of the pivotable spacer arm 44 from the truss 16, and rotates it back into storage position on the support bracket 10*a*. The worker 18 is then able to move to the next truss 16** and repeat the operation.

Figure 6:
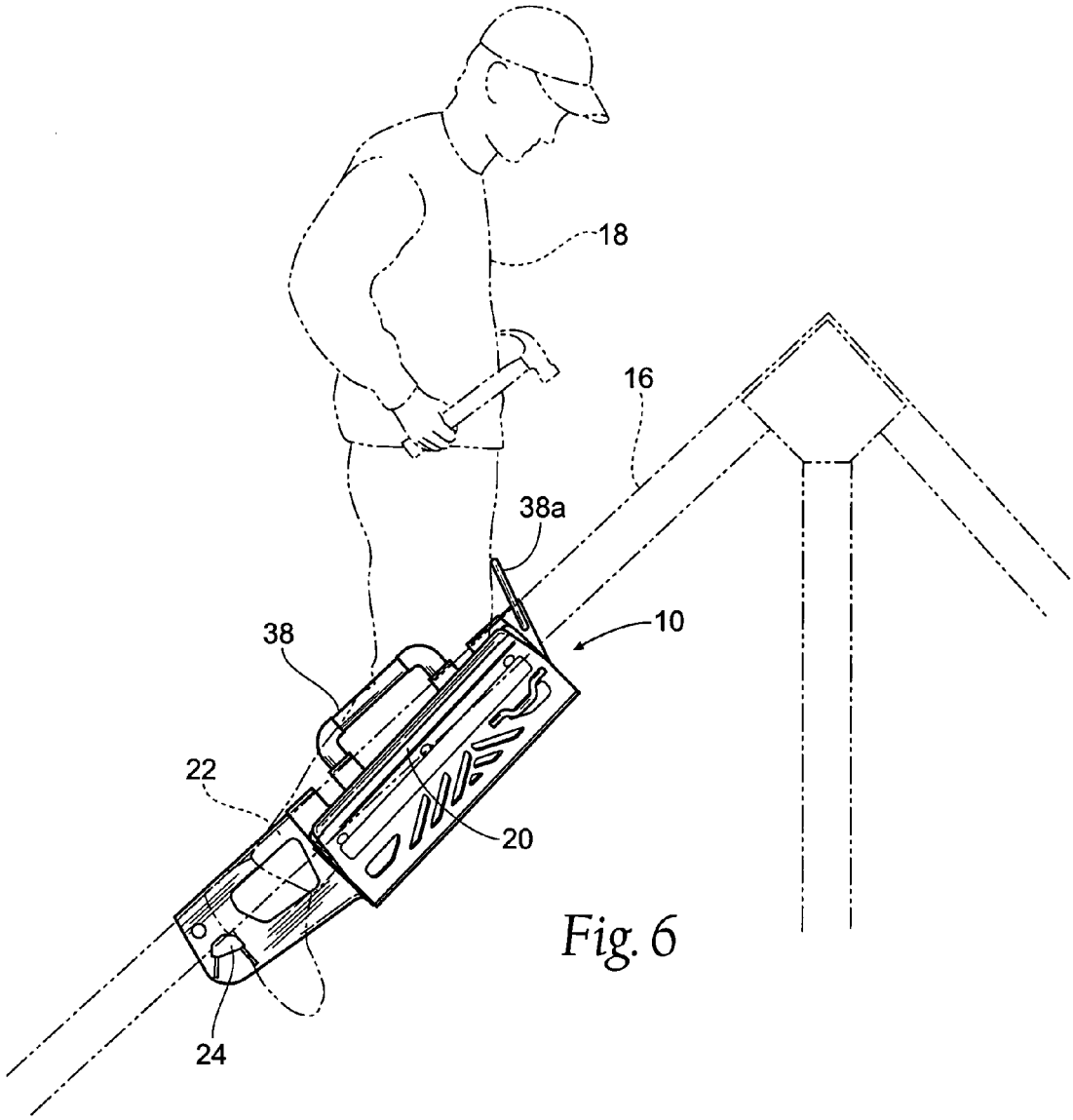
FIG. 6 is a side view of an embodiment of the present invention and illustrating use as support for a worker on a roof truss member.

The present invention also includes a method of erecting trusses atop a building structure, in which a first bracket 10 is attached to a first truss 16 that has been secured in place. As seen in FIGS. 6 and 11, a worker 18 straddles the bracket 10 or 10*a* atop the first truss 16 while securing a second, adjacent truss 16 in place. The worker 18 may either attach a second bracket 10 to the second truss 16 or move the first bracket 10 to the adjacent truss 16. The worker then moves to the second truss 16 and straddles either the moved, first bracket 10 or a second bracket 10. The worker 18 secures a third truss 16 in place adjacent the second truss 16, and the worker 18 either moves the first bracket 10 from the first truss 16 onto the third truss 16, or again moves the first bracket 10 to the third truss 16. This pattern is repeated until the needed number of trusses 16 is secured.

The method may include the steps of: (1) providing a first truss 16 erected atop a building structure; (2) attaching a movable, worker-supporting bracket 10 to the first truss member 16, said bracket 10 including a pair of spaced apart side walls 12 defining a channel 14 therebetween, at least one cross member 11, and each one of said pair of side walls 12 including a laterally extending, substantially parallel trough member 20; (3) straddling said bracket 10 while fixing a second truss member 16 atop the building structure, adjacent to and separated from, the first truss member 16; (4) disengaging said bracket 10 from said first truss member 16; (5) moving said bracket 10 from said first truss member 16 to said second truss member 16; (6) attaching said bracket 10 to said second truss member 16; (7) climbing onto and straddling said bracket 10 while fixing a third truss member 16 atop the building structure adjacent to and spaced from the second truss member 16; and (8) repeating this procedure for erecting trusses 16 one after another.

Alternatively, the method may be practiced using more than one bracket 10 and including the steps of: (1) providing a first truss member 16 erected atop a building structure; (2) attaching a first movable, worker-supporting bracket 10 to the first truss member 16, the bracket 10 including a pair of spaced apart side walls 12 defining a channel 14 therebetween, at least one cross member 11, and each one of said pair of side walls 12 including a laterally extending, substantially parallel trough member 20; (3) straddling the first bracket 10 while fixing a second truss member 16 atop the building structure adjacent to and separated from the first truss member 16; (4) providing a second movable, worker-supporting bracket 10, the bracket 10 including a pair of spaced apart side walls 12 defining a channel 14 therebetween, at least one cross member 11, and each one of the pair of side walls 12 including a laterally extending, substantially parallel trough member 20; (5) attaching the second truss member 16 to the second worker-supporting bracket 10; (6) climbing from the first bracket 10 to the second bracket 10; (7) straddling the second bracket 10 while fixing a third truss member 16 atop the building structure adjacent to and separated from the second truss member 16; (8) disengaging the first bracket 10 from the first truss member 16; (9) moving the first bracket 10 from the first truss member 16 to the third truss member 16; (10) attaching the first bracket 10 to the third truss member 16; (11) climbing onto and straddling the first bracket 10 while fixing a fourth truss member 16 atop the building structure adjacent to and spaced from the third truss member 16; and (12) repeating this procedure for erecting trusses one after another.

Alternatively, the method may be practiced using alternative bracket 10*a* including the steps of: (1) providing a first truss member 16 erected atop a building structure; (2) attaching a first movable, worker-supporting bracket 10*a* to the first truss member 16, said bracket 10 including a pair of spaced apart side walls 12 defining a channel 14 therebetween, at least one cross member 11, each one of said pair of side walls 12 including a laterally extending, substantially parallel trough member 20, and further including a pivotable spacer arm 44; (3) straddling said first bracket 10*a* while rotating the spacer arm 44 to a position substantially perpendicular to the first truss member 16; (4) placing the distal end 46 of the pivotable spacer arm 44 over the incoming second truss member 16 to be secured, so that the pivotable spacer arm 44 holds the incoming second truss member 16 to be secured; (5) fixing a second truss member 16 atop the building structure adjacent to and separated from the first truss member 16; (6) providing a second movable, worker-supporting bracket 10*a*, said bracket 10*a* including a pair of spaced apart side walls 12 defining a channel 14 therebetween, at least one cross member 11, each one of said pair of side walls 12 including a laterally extending, substantially parallel trough member 20, and further including a pivotable spacer arm 44; (6) attaching the second worker-supporting bracket 10*a* to said second truss member 16; (7) climbing from said first bracket 10*a* to said second bracket 10*a*; (8) straddling said second bracket 10*a* while rotating the spacer arm 44 to a position substantially perpendicular to the second truss member 16; (9) placing the distal end 46 of the pivotable spacer arm 44 over the incoming third truss member 16 to be secured, so that the pivotable spacer arm 44 holds the incoming third truss member 16 to be secured; (10) fixing a third truss member 16 atop the building structure adjacent to and separated from the second truss member 16; (11) disengaging said first bracket 10*a* from said first truss member 16; (12) moving said first bracket 10*a* from said first truss member 16 to said third truss member 16; (13) attaching said first bracket 10*a* to said third truss member 16; (14) climbing onto and straddling said first bracket 10*a* while fixing a fourth truss member 16 atop the building structure adjacent to and spaced from the third truss member 16; and (15) repeating this procedure for erecting trusses one after another.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A bracket for supporting a worker atop a work surface such as a truss or construction member including:

a pair of spaced-apart sidewalls defining a channel therebetween;

at least one cross member;

each one of said pair of sidewalls including a laterally extending, substantially parallel trough member;

each one of said pair of sidewalls including a laterally extending, angularly disposed abutment to support said trough members; and means for attaching said bracket to said work surface; wherein said channel having a length greater than a length of said trough members; each one of said pair of sidewalls further includes a laterally extending foot peg member, said foot peg members attached to the side walls at respective locations on the channel and longitudinally spaced along the length of the channel from a respective trough member.

2. The bracket of claim 1, wherein said cross member includes said means for attaching said bracket to said work surface.

3. The bracket of claim 2 wherein said means for attaching said bracket to said work surface comprises releasable fastening means.

4. The bracket of claim 3 wherein said releasable fastening means comprises a keyhole in said cross member, said keyhole being adapted to receive an upstanding member on said work surface.

5. The bracket of claim 3 wherein said releasable fastening means comprises a work holding clamp.

6. The bracket of claim 3 wherein said releasable fastening means comprises a camming device.

7. The bracket of claim 1 further including at least one handle member.

8. The bracket of claim 1 further including at least one pivotally mounted spacer arm.

* * * * *